US005350431A

United States Patent [19]

Yamashita

[11] Patent Number: 5,350,431

[45] Date of Patent: Sep. 27, 1994

[54] PROCESS FOR CHEMICAL DESULFURIZATION OF COAL

[75] Inventor: Toru Yamashita, Sodegaura, Japan

[73] Assignee: Idemitsu Kosan Company Limited, Tokyo, Japan

[21] Appl. No.: 51,159

[22] Filed: Apr. 22, 1993

[30] Foreign Application Priority Data

May 11, 1992 [JP] Japan ..... 4-117644

[51] Int. Cl.[5] ..... C10L 5/00

[52] U.S. Cl. ..... 44/622; 44/505; 201/17

[58] Field of Search ..... 44/505, 622, 602; 423/461; 201/17

[56] References Cited

U.S. PATENT DOCUMENTS

| | | | |
|---|---|---|---|
| 3,387,941 | 6/1968 | Murphy et al. | 423/461 |
| 3,909,213 | 9/1975 | Sanders | 44/622 |
| 4,152,120 | 6/1979 | Zavitsanos et al. | 44/622 |
| 4,401,553 | 8/1983 | Faudel | 208/11 R |

FOREIGN PATENT DOCUMENTS

| | | |
|---|---|---|
| 3-275795 | 12/1991 | Japan . |
| 3-275797 | 12/1991 | Japan . |

*Primary Examiner*—Prince Willis, Jr.
*Assistant Examiner*—Cephia D. Toomer
*Attorney, Agent, or Firm*—Frishauf, Holtz, Goodman & Woodward

[57] ABSTRACT

A process for chemical desulfurization of coal, in which coal is brought into contact with a desulfurizing agent after or while the coal is irradiated with ultraviolet light, thereby to give remarkably high desulfurization ratios and remarkably high yields of low sulfur coal.

19 Claims, No Drawings

PROCESS FOR CHEMICAL DESULFURIZATION OF COAL

BACKGROUND OF THE INVENTION

1. Field of the Invention

The present invention relates to a process for chemical desulfurization of coal.

2. Description of the Prior Art

Coal contains inorganic sulfur mainly composed of pyrite ($FeS_2$) and organic sulfur mainly composed of aliphatic sulfur compounds such as mercaptan, sulfide and disulfide, and aromatic sulfur compounds such as thiophene. benzothiophene and dibenzothiophene. Therefore, when coal is combusted, sulfurous acid gas ($SO_2$) is exhausted into the atmosphere to cause air pollution.

For preventing the exhaustion of the sulfurous gas into atmosphere, a flue gas desulfurization method is widely used. Flue caused by coal combustion is removed by wet-treating with an aqueous solution of an alkali such as calcium hydroxide, etc., to react the sulfurous gas with the alkali. Further, a process for chemical desulfurization of coal has been studied and developed in which coal is chemically treated to remove sulfur compounds from the coal before combustion. For example, JP-A-3-275795 and JP-A-3-275797 disclose a process for chemically removing sulfur compounds from coal, in which crushed coal is mixed with an aqueous solution of sodium hydroxide or potassium hydroxide and the mixture is heated in an oxygen gas atmosphere. This process includes a leaching step in which an oxygen gas is introduced as an oxidizing agent to convert the sulfur compounds into highly chemically reactive tetravalent sulfur oxides and these oxides are absorbed in alkali hydroxide to remove the sulfur compounds from coal. For example, crushed coal is subjected to oxidative alkali leaching treatment using a 0.5 to 10N alkali hydroxide aqueous solution, an oxygen gas, as an oxidizing agent, having a pressure of 1 to 30 $kg/cm^2$ and a temperature of 250° to 450° C., whereby the coal is desulfurized to give coal having a low sulfur content.

However, the process for chemical desulfurization of coal, disclosed in the above publications has the following defects.

(i) Although the inorganic sulfur in the whole sulfur compounds in coal can be nearly completely removed, the organic sulfur is not fully removed. That is because the organic sulfur bonds to a coal matrix more strongly than the inorganic sulfur and is less reactive with an alkali as a desulfurizing agent. In particular, aromatic sulfur compounds such as thiophene and thiophene derivatives are stable themselves and strongly bond to a coal matrix, and these compounds therefore cannot be fully removed.

(ii) Since the oxidation reaction is carried out in an oxygen-containing atmosphere at a high temperature, the oxidation never occurs without oxidizing a coal matrix to decompose it. Thus, the coal properties are affected, and the yield (or recovery) of a low sulfur coal is low.

SUMMARY OF THE INVENTION

It is an object of the present invention to provide a process for chemical desulfurization of coal, which process has advantages that (a) not only an inorganic sulfur but also an organic sulfur can be fully removed with a high desulfurization ratio, and that (b) the reaction conditions for chemical treatment can be moderated, whereby the decomposition of the coal matrix can be prevented and high yields of the low sulfur coal can be achieved.

A study has been made to achieve the above object, and as a result, it has been found that not only the inorganic sulfur but also the organic sulfur can be removed, and the coal matrix is hardly decomposed, by bringing coal into contact with a desulfurizing agent after or while the coal is irradiated with ultraviolet light.

The present invention has been made on the basis of the above finding. The gist of the present invention consists in a process for chemical desulfurization of coal, which comprises a step of bringing coal into contact with a desulfurizing agent after or while the coal is irradiated with ultraviolet light.

DETAILED DESCRIPTION OF THE INVENTION

The present invention will be detailed hereinafter.

In the present invention, the coal to be subjected to desulfurization treatment includes coal of any kinds such as peat, lignite, brown coal, bituminous coal and anthracite. These kinds of coal generally have 0.3 to 10% of a sulfur content. The process of the present invention can be applied to these kinds of coal having a variety of sulfur contents. In particular, when applied to coal containing a large amount of aromatic sulfur compounds such as thiophene and its derivatives (e.g., benzothiophene and dibenzothiophene), the process of the present invention can achieve a higher desulfurization ratio than any prior art process, as will be described later.

In the present invention, it is preferred to crush coal into fine particles before desulfurization treatment. That is because the smaller the diameter of crushed coal particles is, the more promoted are the decomposition reaction of aromatic sulfur compounds by ultraviolet light irradiation and the desulfurization reaction with a desulfurizing agent which will be described later. The diameter of the crushed coal particles is preferably 10 mm or less, more preferably 0.5 mm or less.

In the present invention, it is an essential requirement to irradiate the above coal with ultraviolet light. For example, coal is irradiated with ultraviolet light from a high-pressure mercury lamp having a wavelength of 200 to 600 nm or an ultrahigh-pressure mercury lamp. The time for the irradiation is preferably 1 minute to 10 hours, particularly preferably 1 to 2 hours.

Under the irradiation with ultraviolet light, aromatic sulfur compounds strongly bonding to the coal matrix are photo-decomposed to form non-aromatic sulfur compounds having decreased bonding force to the coal matrix. In the case of thiophene as an aromatic sulfur compound, the above step is illustrated as follows.

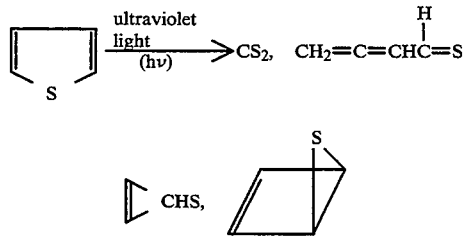

Benzothiophene and dibenzothiophene undergo similar photo-decomposition reactions. Since the non-aromatic sulfur compounds obtained by ultraviolet light irradiation have decreased bonding force to the coal matrix as described above, they easily react with a desulfurizing agent to be described later and therefore are removed from coal. Due to this, the process of the present invention, which comprises ultraviolet light irradiation as an essential requirement, can remove hardly-removable aromatic sulfur compounds and can achieve high desulfurization ratio.

Ultraviolet light used for the irradiation of coal serves to decompose organic sulfur compounds alone, and has no influence on the coal matrix. Therefore, differing from a prior art process using an oxygen gas, the process of the present invention never deteriorates the coal properties, nor does it cause the subsequent decrease in the yield of a low sulfur coal.

In the present invention, the irradiation of coal with ultraviolet light is carried out before or during the desulfurization reaction of the coal with a desulfurizing agent.

The desulfurizing agent can be freely selected from desulfurizing agents conventionally used for coal desulfurization. Specific examples of the desulfurizing agent include alkali compounds such as sodium hydroxide, potassium hydroxide, calcium hydroxide, sodium carbonate, potassium carbonate and calcium carbonate and aqueous solutions of these; oxidizing agents such as potassium permanganate, sodium hypochlorite, hydrogen peroxide and chlorine water; and metal chlorides such as $CaCl_2$ and $FeCl_3$. It is particularly preferred to use an alkali compound or an aqueous solution thereof.

The amount of the desulfurizing agent for use based on the coal amount is generally 5 to 300% (as a solid content), particularly preferably 20 to 100%.

In the present invention, the desulfurization reaction is preferably carried out by mixing a desulfurizing agent with coal in a mixing tank, then introducing the mixture into a desulfurization reactor equipped with a stirring device and bringing the desulfurizing agent into contact with the coal in the same reactor.

The desulfurization reaction is preferably carried out at a temperature of 0° to 450° C. under a pressure of atmospheric pressure to 50 kg/cm$^2$ for 30 seconds to 48 hours.

In the present invention, aromatic sulfur compounds in coal are converted to easily desuflurizable non-aromatic sulfur compounds by irradiating the coal with ultraviolet light before or while the coal is brought into contact with the desulfurizing agent, whereby high desulfurization rates can be achieved. Further, the coal matrix is not deteriorated under ultraviolet light irradiation, and high yields of low sulfur coal can be achieved.

Coal obtained by the desulfurization treatment is washed with water or an acid, and dried to give coal having a low sulfur content.

The present invention will be explained hereinafter by contrasting Examples with Comparative Examples.

EXAMPLE 1

Three kinds of coal crushed into fine particles having a diameter of 0.25 mm or less were dried at 107° C. to obtain coal test samples A, B and C. The samples were analyzed for sulfur types, and Table 1 shows the results.

TABLE 1

| Coal name | Country of origin | Total sulfur (%) | Inorganic sulfur (%) | Organic sulfur (%) |
|---|---|---|---|---|
| A Illinois No. 6 | U.S.A. | 4.16 | 2.18 | 1.98 |
| B Mitsui Miike | Japan | 2.37 | 1.37 | 1.30 |
| C Heisaku | China | 1.01 | 0.13 | 0.98 |

20 Grams each of the above samples A, B and C was separately placed in a quartz glass tube, and irradiated with ultraviolet light under argon atmosphere for 1 hour. The irradiation conditions were as follows.

Ultraviolet light source: High-pressure mercury lamp
Wavelength of ultraviolet light: 229 nm
Temperature in irradiation: Room temperature
Pressure in irradiation: atmospheric pressure The above coal samples irradiated with ultraviolet light were separately mixed with 100 ml of a 2N NaOH aqueous solution, and the resultant mixtures were independently placed in a 300 ml autoclave to subject it to an alkali leaching reaction. The reaction conditions were as follows.

Reaction temperature: 200° C.
Reaction time: 1 hour

The reaction mixtures containing the reacted coal samples and the alkali leaching solutions were respectively neutralized with 2N hydrochloric acid. The coal samples were subjected to solid-liquid separation, and then dried under nitrogen atmosphere at 107° C. Table 2 summarizes the test results.

EXAMPLE 2

20 Grams each of the same coal samples A, B and C as those used in Example 1 was fully mixed with 100 ml of a 2N NaOH aqueous solution, and the mixtures were placed in 300 ml autoclaves and subjected to an alkali leaching reaction under the same conditions as those in Example 1. During this reaction, the mixtures were irradiated with ultraviolet light for 1 hour. The irradiation conditions were as follows.

Ultraviolet light source: High-pressure mercury lamp
Wavelength of ultraviolet light: 229 nm The coal samples which had reacted were treated in the same manner as in Example 1. Table 2 summarizes the test results.

EXAMPLE 3

20 Grams each of coal samples A, B and C was separately placed in a quartz glass tube, and irradiated with ultraviolet light under the same conditions as those in Example 1. Then, the coal samples were independently fully mixed with 100 ml each of 2N sodium hypochlorite aqueous solutions and reacted under the following conditions.

Reaction temperature: Room temperature
Reaction pressure: atmospheric pressure
Reaction time: 1 hour Aqueous solutions of $Na_2CO_3$ were added to the coal samples which had reacted, and the mixtures were refluxed at 80° C. for 1 hour, washed and dried. Table 2 summarizes the test results.

EXAMPLE 4

20 Grams each of coal samples A, B and C was fully mixed with 100 ml each of 2N sodium hypochlorite aqueous solutions, and the mixtures were allowed to react under the same conditions as those in Example 3.

During the reactions, the coal samples were irradiated with ultraviolet light under the same conditions as those in Example 3 for 1 hour. The coal samples which had reacted were treated with an aqueous solution of $Na_2CO_3$ in the same manner as in Example 3. Table 2 summarizes the test results.

EXAMPLE5

20 Grams each of coal samples A, B and C was placed in a quartz glass tube, and irradiated with ultraviolet light under the same conditions as those in Example 1. Then, the coal samples were independently fully mixed with 100 ml each of 2N $FeCl_3$ aqueous solutions as a desulfurizing agent, and the mixtures were placed in ml autoclaves and allowed to react under the following conditions.

Reaction temperature: 200° C.

Reaction time: 1 hour

The coal samples which had reacted were washed with water and dried. Table 2 summarizes the test results.

EXAMPLE 6

20 Grams each of coal samples A, B and C was independently fully mixed with 100 ml each of 2N $FeCl_3$ aqueous solutions as a desulfurizing agent, and the mixtures were placed in 300 ml autoclaves and allowed to react under the same conditions as in Example 5. During the reactions, the coal samples were irradiated with ultraviolet light under the same conditions as those in Example 1 for 1 hour. The coal samples which had reacted were washed with water and dried. Table 2 summarizes the test results.

COMPARATIVE EXAMPLE 1

20 Grams each of coal samples A, B and C was independently fully mixed with 100 ml each of 2N NaOH aqueous solutions as a desulfurizing agent without irradiating them with ultraviolet light. Then, the mixtures were placed in a 300 ml autoclave and subjected to alkali leaching reactions. The reaction conditions were as follows.

Reaction temperature: 200° C.

Reaction time: 1 hour

The reaction mixtures containing the coal samples which had reacted and alkali leaching solutions were cooled and then neutralized with 2N hydrochloric acid. The reaction mixtures were subjected to solid-liquid separation, and then the coal samples were washed and dried under nitrogen atmosphere at 107° C. Table 3 summarizes the test results.

COMPARATIVE EXAMPLE 2

20 Grams each of coal samples A, B and C was independently fully mixed with 100 ml each of 2N sodium hypochlorite aqueous solutions as a desulfurizing agent without irradiating them with ultraviolet light, and the mixtures were allowed to react under the following conditions.

Reaction temperature: Room temperature

Reaction pressure: Atmospheric pressure

Reaction time: 1 hour

Aqueous solutions of $Na_2CO_5$ were added to the coal samples which had reacted, and the mixtures were refluxed at 80° C., washed and dried. Table 3 summarizes the test results.

COMPARATIVE EXAMPLE 3

20 Grams each of coal samples A, B and C was independently fully mixed with 100 ml each of 2N $FeCl_3$ aqueous solutions as a desulfurizing agent without irradiating them with ultraviolet light, and the mixtures were placed in 300 ml autoclaves and allowed to react under the following conditions.

Reaction temperature: 200° C.

Reaction time: 1 hour

The coal samples which had reacted were washed with water and dried. Table 3 summarizes the test results.

COMPARATIVE EXAMPLE 4

Coal was subjected to desulfurization treatment in which the coal was brought into contact with a desulfurizing agent under oxygen-containing atmosphere according to JP-A-3-275795. The details of the desulfurization treatment were as follows.

20 Grams each of coal samples A, B and C was independently mixed with 130 ml each of 5N NaOH aqueous solutions, and the mixtures were placed in 300 ml autoclaves. An oxygen gas was introduced into the autoclaves up to an oxygen pressure of 15 kg/cm$^2$G, and then the mixtures were subjected to alkali leaching reactions at a reaction temperature of 370° C. for a reaction time of 1 hour.

The reaction mixtures containing the coal samples which had reacted and the leaching solutions were cooled and a carbonic acid gas was blown into the reaction mixtures to neutralize them. The reaction mixtures were subjected to solid-liquid separation, and the coal samples were washed and dried under nitrogen atmosphere at summarizes the test results.

TABLE 2

| | Sample | Total sulfur (%) Before reaction | Total sulfur (%) After reaction | Desulfurization ratio (%) | Weight of coal matrix (g)* Before reaction | Weight of coal matrix (g)* After reaction | Recovery (%) |
|---|---|---|---|---|---|---|---|
| Ex.1 | A | 4.16 | 0.12 | 97.1 | 17.9 | 17.5 | 97.8 |
| | B | 2.37 | 0.10 | 95.8 | 15.4 | 14.6 | 95.0 |
| | C | 1.01 | 0.04 | 96.0 | 17.3 | 16.6 | 96.1 |
| Ex.2 | A | 4.16 | 0.18 | 95.7 | 17.9 | 17.4 | 97.6 |
| | B | 2.37 | 0.15 | 93.8 | 15.4 | 14.6 | 94.8 |
| | C | 1.01 | 0.09 | 91.1 | 17.3 | 16.5 | 95.6 |
| Ex.3 | A | 4.16 | 0.83 | 80.0 | 17.9 | 17.6 | 98.2 |
| | B | 2.37 | 0.41 | 82.7 | 15.4 | 14.4 | 98.8 |
| | C | 1.01 | 0.18 | 82.2 | 17.3 | 17.0 | 98.4 |
| Ex.4 | A | 4.16 | 0.90 | 78.4 | 17.9 | 17.5 | 97.6 |
| | B | 2.37 | 0.46 | 80.6 | 15.4 | 14.3 | 98.0 |
| | C | 1.01 | 0.23 | 77.2 | 17.3 | 16.8 | 96.9 |
| Ex.5 | A | 4.16 | 1.05 | 74.8 | 17.9 | 17.6 | 98.6 |
| | B | 2.37 | 0.61 | 74.3 | 15.4 | 14.3 | 98.2 |
| | C | 1.01 | 0.23 | 77.2 | 17.3 | 17.1 | 99.0 |
| Ex.6 | A | 4.16 | 1.21 | 70.9 | 17.9 | 17.6 | 98.4 |
| | B | 2.37 | 0.76 | 67.9 | 15.4 | 14.3 | 98.0 |
| | C | 1.01 | 0.30 | 70.3 | 17.3 | 17.1 | 98.6 |

Ex. = Example

*Weight of coal matrix is a weight (g) obtained by deducting an ash content from a coal weight.

TABLE 3

| | Sample | Total sulfur (%) Before reaction | Total sulfur (%) After reaction | Desulfurization ratio (%) | Weight of coal matrix (g)* Before reaction | Weight of coal matrix (g)* After reaction | Recovery (%) |
|---|---|---|---|---|---|---|---|
| CEx. 1 | A | 4.16 | 1.67 | 59.9 | 17.9 | 17.5 | 98.0 |
| | B | 2.37 | 1.18 | 50.2 | 15.4 | 14.6 | 95.1 |

TABLE 3-continued

| | Sample | Total sulfur (%) Before reaction | Total sulfur (%) After reaction | Desulfurization ratio (%) | Weight of coal matrix (g)* Before reaction | Weight of coal matrix (g)* After reaction | Recovery (%) |
|---|---|---|---|---|---|---|---|
| | C | 1.01 | 0.88 | 12.9 | 17.3 | 16.7 | 96.4 |
| CEx. 2 | A | 4.16 | 2.30 | 44.7 | 17.9 | 17.6 | 98.6 |
| | B | 2.37 | 1.31 | 44.7 | 15.4 | 15.2 | 99.0 |
| | C | 1.01 | 0.96 | 5.0 | 17.3 | 17.3 | 98.8 |
| CEx. 3 | A | 4.16 | 2.54 | 38.9 | 17.9 | 17.8 | 99.5 |
| | B | 2.37 | 1.81 | 23.6 | 15.4 | 15.2 | 99.0 |
| | C | 1.01 | 0.98 | 3.0 | 17.3 | 17.2 | 99.4 |
| CEx. 4 | A | 4.16 | 0.20 | 95.2 | 17.9 | 14.7 | 82.0 |
| | B | 2.37 | 0.15 | 93.8 | 15.4 | 12.1 | 78.8 |
| | C | 1.01 | 0.08 | 92.0 | 17.3 | 13.9 | 80.6 |

CEx. = Comparative Example
*Weight of coal matrix is a weight (g) obtained by deducting an ash content from a coal weight.

As will be clear by contrasting the results of Examples 1 to 6 in Table 2 with the results of Comparative Examples 1 to 3 in Table 3, the desulfurization ratios in Examples 1 to 6 using desulfurization treatment with a desulfurizing agent and irradiation with ultraviolet light in combination are as high as 70.9 to 97.1% for coal A, 67.9 to 95.8% for coal B and 70.3 to 96.0% for coal C, and these desulfurization ratios are remarkably higher than the desulfurization ratios obtained in Comparative Examples 1 to 3 using desulfurization treatment alone without carrying out the irradiation with ultraviolet light (38.9 to 59.9% for coal A, 23.6 to 50.2% for coal B and 3.0 to 12.9% for coal C). These results show that the present invention gives a synergistic effect produced by the use of desulfurization treatment with a desulfurizing agent and irradiation with ultraviolet light in combination.

Table 3 also shows the results of Comparative Example 4 in which the coal samples were desulfurized by bringing them into contact with a desulfurizing agent under oxygen-containing atmosphere according to the disclosure of JP-A-3-275795. In Comparative Example 4, the desulfurization ratio of coal A was 95.2% and the coal matrix yield was 82.0, which data are inferior to the desulfurization ratio of 97.1% and the coal matrix yield of 97.8% in Example 1 using the same desulfurizing agent. Further, Example 1 showed higher desulfurization ratios and higher coal matrix yields of coal B and coal C than those in Comparative Example 4. These results show that the process for desulfurization of coal, provided by the present invention, is excellent over the conventional process for desulfurization of coal, disclosed in JP-A-5-275795, in desulfurization ratio and yield of coal matrix.

As explained above, the present invention provides a process for chemical desulfurization of coal which gives remarkably high desulfurization ratios and remarkably high yields of coal matrix.

What is claimed is:

1. A process for chemical desulfurization of coal, which comprises bringing coal into contact with a desulfurizing agent after or while the coal is irradiated with ultraviolet light for 1 minute to 10 hours.

2. A process according to claim 1, wherein the coal is at least one member selected from the group consisting of peat, lignite, brown coal, bituminous coal and anthracite.

3. A process according to claim 1, wherein the coal contains an aromatic sulfur compound.

4. A process according to claim 1, wherein the coal to be subjected to the chemical desulfurization is preliminarily crushed.

5. A process according to claim 1, wherein the coal has a particle diameter of 10 mm or less.

6. A process according to claim 1, wherein the coal is irradiated with ultraviolet light from a high-pressure mercury lamp or an ultrahigh-pressure mercury lamp.

7. A process according to claim 6, wherein the coal is irradiated with ultraviolet light having a wavelength of 200 nm.

8. A process according to claim 1, wherein the coal is irradiated with ultraviolet light for 1 to 2 hours.

9. A process according to claim 1, wherein the desulfurizing agent is an alkali compound or an aqueous solution thereof.

10. A process according to claim 9, wherein the alkali compound is selected from the group consisting of sodium hydroxide, potassium hydroxide, calcium hydroxide, sodium carbonate, potassium carbonate and calcium carbonate.

11. A process according to claim 1, wherein the desulfurizing agent is an oxidizing agent.

12. A process according to claim 11, wherein the oxidizing agent is selected from the group consisting of potassium permanganate, sodium hypochlorite, hydrogen peroxide and chlorine water.

13. A process according to claim 1, wherein the desulfurizing agent is a metal chloride.

14. A process according to claim 13, wherein the metal chloride is $CaCl_2$ or $FeCl_3$.

15. A process according to claim 1, wherein the desulfurizing agent is used in an amount of 5 to 300% as a solid content based on the amount of the coal.

16. A process according to claim 1, wherein the chemical desulfurization is carried out at a temperature of 0° to 450° C. at a pressure of atmospheric pressure to 50 kg/cm$^2$ for 30 seconds to 48 hours.

17. A process according to claim 1, wherein the desulfurized coal is washed with an acid and dried.

18. The process according to claim 2, wherein the coal contains 0.3 to 10% sulfur; and the coal has a particle diameter of 5 mm or less.

19. The process according to claim 18, wherein the coal is irradiated with ultraviolet light having a wavelength of 200 to 229 nm for 1 to 2 hours; the chemical desulfurization is carried out at a temperature of 0° to 450° C., at a pressure of atmospheric pressure to 50 kg/cm$^2$ for 30 seconds to 48 hours with a desulfurizing agent selected from the group consisting of sodium hydroxide, potassium hydroxide, calcium hydroxide, sodium carbonate, potassium carbonate, calcium carbonate, potassium permanganate, sodium hypochlorite, hydrogen peroxide, $CaCl_2$ and $FeCl_2$.

* * * * *